US009981176B2

(12) United States Patent
Dorrell

(10) Patent No.: US 9,981,176 B2
(45) Date of Patent: May 29, 2018

(54) SPORT RACKET VIBRATION DAMPENER AND SCORE KEEPING DEVICE AND METHODS OF USE

(71) Applicant: Ronald K. Dorrell, Kennesaw, GA (US)

(72) Inventor: Ronald K. Dorrell, Kennesaw, GA (US)

( * ) Notice: Subject to any disclaimer, the term of this patent is extended or adjusted under 35 U.S.C. 154(b) by 0 days. days.

(21) Appl. No.: 15/331,422

(22) Filed: Oct. 21, 2016

(65) Prior Publication Data

US 2017/0203189 A1 Jul. 20, 2017

Related U.S. Application Data

(63) Continuation of application No. 62/279,880, filed on Jan. 18, 2016.

(51) Int. Cl.

| | |
|---|---|
| ***A63B 71/06*** | (2006.01) |
| ***A63B 49/00*** | (2015.01) |
| ***A63B 60/54*** | (2015.01) |
| ***A63B 60/00*** | (2015.01) |

(52) U.S. Cl.

CPC ..... *A63B 71/0672* (2013.01); *A63B 49/00* (2013.01); *A63B 60/00* (2015.10); *A63B 60/54* (2015.10)

(58) Field of Classification Search

CPC . A63B 71/06; A63B 71/0619; A63B 71/0669; A63B 71/0672; A63B 2071/0602; A63B 2071/0658; A63B 60/00; A63B 60/54; A63B 49/00

See application file for complete search history.

(56) References Cited

U.S. PATENT DOCUMENTS

| | | | | | |
|---|---|---|---|---|---|
| 4,165,710 | A * | 8/1979 | Gaetano | A63B 71/0672 | 116/223 |
| 4,172,595 | A * | 10/1979 | Sewell | A63B 71/0672 | 116/225 |
| 4,331,098 | A * | 5/1982 | Rubano | A63B 71/0672 | 116/225 |
| 4,738,449 | A * | 4/1988 | Droz | A63B 71/0672 | 116/222 |
| 5,879,249 | A * | 3/1999 | Fox-Gurcay | A63B 24/0021 | 473/553 |
| 6,012,995 | A * | 1/2000 | Martin | A63B 71/0622 | 340/323 R |

(Continued)

*Primary Examiner* — Raleigh W Chiu

(74) *Attorney, Agent, or Firm* — Mathew L. Grell; Jeffrey C. Watson; Grell & Watson Patent Attorneys LLC

(57) ABSTRACT

An apparatus to keep score during a tennis or other racket match being affixed to a set of racket strings, the apparatus includes a housing having a perimeter, a front surface and a rear surface, each surface configured with indicia to indicate game and set score, said perimeter includes a groove there-around to removeably affix housing to the racket strings, wherein the housing includes a pair of stacked polygon apertures, the front polygon being a hexagon and the second being a pentagon, and a pair of stacked pluggable dials, the front polygon being a hexagon and the second being a pentagon, wherein said pluggable dials include a finger grip, indicator, base or stop, and annular male female snap, and thus to facilitate keeping game and set score during a match and to provide vibrational dampening.

13 Claims, 8 Drawing Sheets

(56) References Cited

U.S. PATENT DOCUMENTS

| | | | | |
|---|---|---|---|---|
| 7,300,366 | B1 * | 11/2007 | Hickey | A63B 71/0672 473/522 |
| 7,517,293 | B1 * | 4/2009 | Smith | A63B 49/00 273/DIG. 26 |
| 2002/0072438 | A1 * | 6/2002 | Boxer | A63B 71/0672 473/553 |
| 2007/0265120 | A1 * | 11/2007 | Hickey | A63B 71/0672 473/520 |
| 2015/0141177 | A1 * | 5/2015 | Rock | A63B 71/0672 473/553 |
| 2017/0203189 | A1 * | 7/2017 | Dorrell | A63B 71/0672 |

* cited by examiner

SPORT RACKET VIBRATION DAMPENER AND SCORE KEEPING DEVICE AND METHODS OF USE

CROSS REFERENCE TO RELATED APPLICATIONS

To the full extent permitted by law, the present United States Non-provisional Patent Application hereby claims priority to and the full benefit of, United States Provisional Application entitled "Tennis racket vibration dampener and score keeping device," having assigned Ser. No. 62/279,880, filed on Jan. 18, 2016, which is incorporated herein by reference in its entirety.

TECHNICAL FIELD

The disclosure relates generally to scoring devices and more specifically it relates to a racket sport scoring and vibration dampening device.

BACKGROUND

Sports scoring devices and more specifically tennis scoring devices come in a variety of forms such as travel to scoring devices positioned near the net or perimeter of the court. A few devices are wearable and only a few of those devices may be mounted on the racket or wrist band. Even fewer are capable of a dual purpose wherein the device may be utilized to keep score as well as function as a tennis racket dampening device to dampen the vibrations caused by the impact of a tennis ball impacting the string bed of a tennis racket, which helps protect against wrist, elbow and shoulder injuries.

One previous approach of a combination dampening and score keeping device includes a pair of intermatable housing sections for mating through said strings and additionally, the outer face of the top wall of each member bears indicia of the tennis scoring system and includes means to mount a rotating face plate that features a window to allow the player to rotate said face plate to the indicated score at any time during the tennis match. One disadvantage of this approach is that this prior product does not include the ability to keep or record both players' Set scores. The prior product only keeps or records Game scores. Additionally, these prior products require a player to visually insure accurate movement of the device to the precise score position without a precise physical reinforcement of the score position.

Another previous approach of a combination dampening and score keeping device includes a cylinder provided with a slot (or groove) extending circumferentially around the cylinder, partially bisecting it into two generally planar portions (e.g., wheels) connected by an interior hub. The innermost annular surface of the hub is provided with a regular polygonal shape having an even number of sides equaling the number of different scores printed on one or both of the planar portions to rotate therebetween. One disadvantage of this approach is that this prior product does not include the ability to keep or record both players' Set scores. The prior product only keeps or records Game scores. Additionally, these prior products require a player to visually insure accurate movement of the device to the precise score position without a precise physical reinforcement of the score position.

Therefore, it is readily apparent that there is a recognizable unmet need for a sport racket vibration dampener and score keeping device and methods of use thereof that functions to dampen the vibrations caused by the impact of a tennis ball impacting the string bed of a tennis racket and enable accurate game and set scoring for each player during a match.

BRIEF SUMMARY

Briefly described, in example embodiment, the present apparatus overcomes the above-mentioned disadvantage, and meets the recognized need for a sport racket vibration dampener and score keeping device and methods of use, by providing a housing having a perimeter, a front surface and a back surface, each surface configured with indicia to indicate game and set, the perimeter configured having a groove therearound to removeably affix said housing to the racket strings, wherein said housing includes a pair of stacked polygon apertures formed therein the front surface and back surface, a first or front polygon aperture configured as a hexagon shape and a second or back polygon aperture configured as a pentagon shape, a pair of layered pluggable dials each positioned therein the first or front polygon and the second or back polygon, the pair of stacked pluggable dials includes a first or front dial configured as a hexagon shape and a second or back dial configured as a pentagon shape, wherein each said pluggable dial is positioned therein one of said a pair of stacked polygon apertures, wherein each of said pair of stacked pluggable dials includes a finger grip, an indicator, a base or stop, and either an annular male or female snap/connector, and, thus, functions to dampen the vibrations caused by the impact of a tennis ball impacting the string bed of a tennis racket and enable accurate game and set scoring for each player during a match.

According to its major aspects and broadly stated, the disclosure includes a pair of stacked polygon apertures having a first or front polygon being having n+1 sides and a second or back polygon having n sides. Furthermore, disclosure includes a pair of stacked pluggable dials having a first or front dial having a polygon shape having n+1 sides and the second or back dial having a polygon shape having n sides.

Accordingly, a feature of the sport racket vibration dampener and score keeping device and methods of use is its ability to keep track of two players, such as player one or home and player two or visitor. Points won during a single game and games won during a single set. In use, full rotation clockwise single game: 0 (or "love"), 15, 30, and 40 and of "advantage" (e.g., "AD") indicates a single game won for either player. Reset each player to 0 (or "love") to play the next game. The game won will be recorded on the other side as games won during a single set by incrementing one position clockwise: 0, 1, 2, 3, 4, 5, 6. First player to 6 games (win by two games) wins the set. Typically, in recreational match play, two sets won out of three possible sets wins the match.

In a preferred embodiment, an apparatus to keep score of a game and set during a racket match, the apparatus including a housing having a perimeter, a front surface and a back surface, each surface configured with an indicia to indicate the game and set score, the perimeter having a groove therearound, and the housing includes a pair of apertures, each of the pair of apertures having one or more layered aperture surfaces, wherein the one or more layered aperture surfaces includes a first ratchet aperture surface configured as a hexagon and a second ratchet aperture surface configured as a pentagon, and two pairs of dials, each of the pair of dials having one or more layered dial surfaces, the one or more layered dial surfaces includes a first ratchet dial surface configured as a hexagon and a second dial configured in part as a pentagon, wherein each of the pairs of dials is rotationally positioned therein one of the pair of apertures, wherein each of the pairs of dials includes a finger grip, an indicator, a base, and an annular connector.

In still a further exemplary embodiment, a method of utilizing an apparatus to keep score of a game and set during a racket match, the method including the steps of providing a housing having a perimeter, a front surface and a back surface, each surface configured with an indicia to indicate either the game and set score, the perimeter having a groove therearound, and the housing includes a pair of apertures, each of the pair of apertures having one or more layered aperture surfaces, wherein the one or more layered aperture surfaces includes a first ratchet aperture surface configured as a hexagon and a second ratchet aperture surface configured as a pentagon, and two pairs of dials, each of the pair of dials having one or more layered dial surfaces, the one or more layered dial surfaces includes a first ratchet dial surface configured as a hexagon and a second dial configured in part as a pentagon, wherein each of the pairs of dials is rotationally positioned therein one of the pair of apertures, wherein each of the pairs of dials includes a finger grip, an indicator, a base, and an annular connector, affixing a set of racket strings therein the groove of the housing, setting each of the pair of dials to a start position, rotating one of the pair of dials thereon the back surface at least one position clockwise, scoring a win of a game point, rotating one of the pair of dials thereon the front surface one position clockwise after winning a game.

Accordingly, a feature of the sport racket vibration dampener and score keeping device and methods of use is its ability to manually record each player's Game score and also record each player's Set score.

Another feature of the sport racket vibration dampener and score keeping device and methods of use is its ability to aid tennis players with near vision issues by reinforcing score positions with a physical stop at a precise index made possible using a combination feature of differing shaped polygon sided openings within the rubber housing and annular snap attached polygon shaped dials.

Still another feature of the sport racket vibration dampener and score keeping device and methods of use is its ability to enable a player to manually keep track of, record, and/or display numeric score, such as points won during a single game: 0 (or "love"), 15, 30, and 40 and of "advantage" (e.g., "AD") or any other numerical scoring indicia on one side.

Yet another feature of the sport racket vibration dampener and score keeping device and methods of use is its ability to enable a player to manually keep track of, record and/or display numeric score, such as games won during a single set: 0, 1, 2, 3, 4, 5, 6 or any other numerical games won indicia on an opposite side or the same one side.

Yet another feature of the sport racket vibration dampener and score keeping device and methods of use is its ability to display or record two scoring systems on opposite sides in one apparatus.

Yet another feature of the sport racket vibration dampener and score keeping device and methods of use is its ability to display or record two or more challengers scoring systems, such as home and visitor, team 1 and team 2, player 1 and player 2, or the like on opposite sides of one apparatus.

Yet another feature of the sport racket vibration dampener and score keeping device and methods of use is its ability to provide game score display or recording for both players on the same side of the device and set score on the opposite side which allows a player to quickly identify the game score and set score relationships between two or more players.

Yet another feature of the tennis racket vibration dampener and score keeping device and methods of use is its ability to aid players with near vision sight issues by reinforcing score positions with a dial having a physical stop at a precise index. This feature is made possible using a combination feature of differing shaped polygon openings within the housing and annular snap attached polygon shaped dials, which ratchet and set in the next polygon opening position.

Yet another feature of the sport racket vibration dampener and score keeping device and methods of use is its ability to function as a combination score keeping device and racket vibration dampening device. The vibration dampening is achieved, such as by utilizing a rubber composite housing having a perimeter groove fastened within the string bed of a sport racket. This is accomplished by manually placing the sport racket strings (vertical strings) into the manufactured grooves in the device housing sides.

Yet another feature of the sport racket vibration dampener and score keeping device and methods of use is its ability to provide a vibration dampening mount formed from any flexible material or varying durometer, such a rubber, plastic, Styrofoam or like material. Durometer is the measure of hardness of a material.

Yet another feature of the sport racket vibration dampener and score keeping device and methods of use is its ability to provide a convenient and readily usable tennis scoring and dampening device that is directly attached to the bed of strings of a tennis racket.

Yet another feature of the sport racket vibration dampener and score keeping device and methods of use is its ability to provide polygon designed ratchet dial rotation feature to precisely indicate individual game and set scores relative to home and visitor match play.

Yet another feature of the sport racket vibration dampener and score keeping device and methods of use is its ability to provide player one or home "H" and player 2, opponent, or visitor "V" for both players scores on the same face or surface side (rather than opposing sides) enhancing the players ability to immediately determine the home vs visitor score relationship.

Yet another feature of the sport racket vibration dampener and score keeping device and methods of use is its ability to provide different face or surface colors enabling immediate recognition of which side is game score and which is set score.

Yet another feature of the sport racket vibration dampener and score keeping device and methods of use is its ability to provide score keeping accessories and vibrational dampening for racquet sports such as tennis, racquetball, and squash.

These and other features of the sport racket vibration dampener and score keeping device and methods of use will become more apparent to one skilled in the art from the following Detailed Description of the Embodiments and Claims when read in light of the accompanying drawing Figures.

BRIEF DESCRIPTION OF THE DRAWINGS

The present sport racket vibration dampener and score keeping device and methods of use will be better understood by reading the Detailed Description of the embodiments with reference to the accompanying drawing figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-9, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
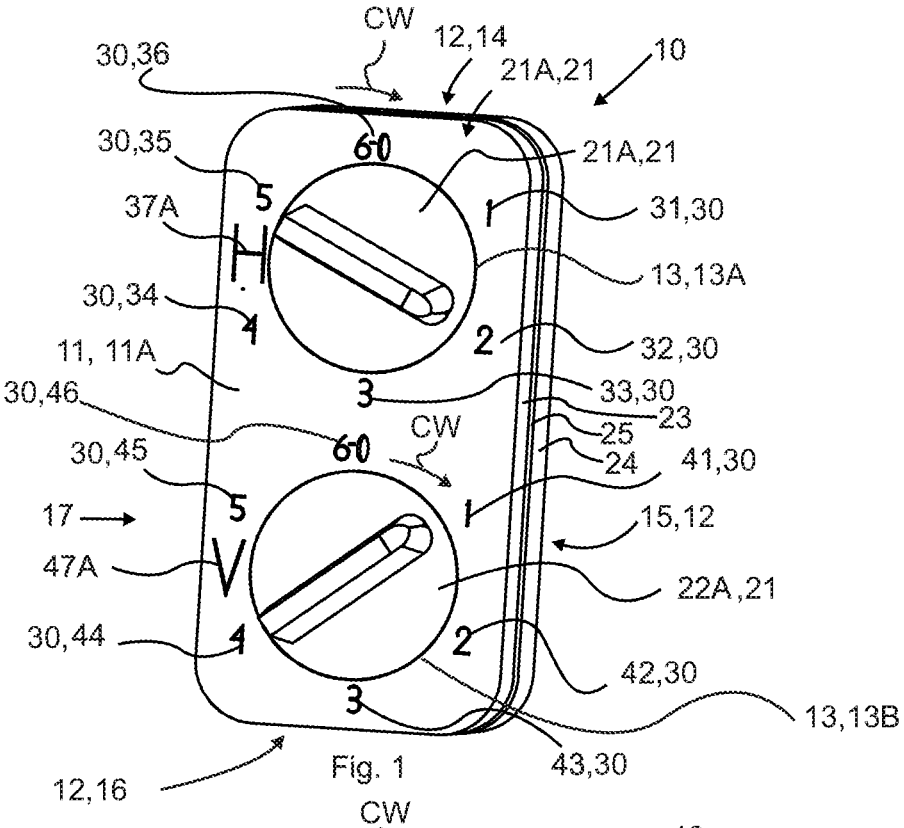
FIG. 1 is a front perspective view of an exemplary embodiment of the sport racket vibration dampener and score keeping device.
Figure 2:
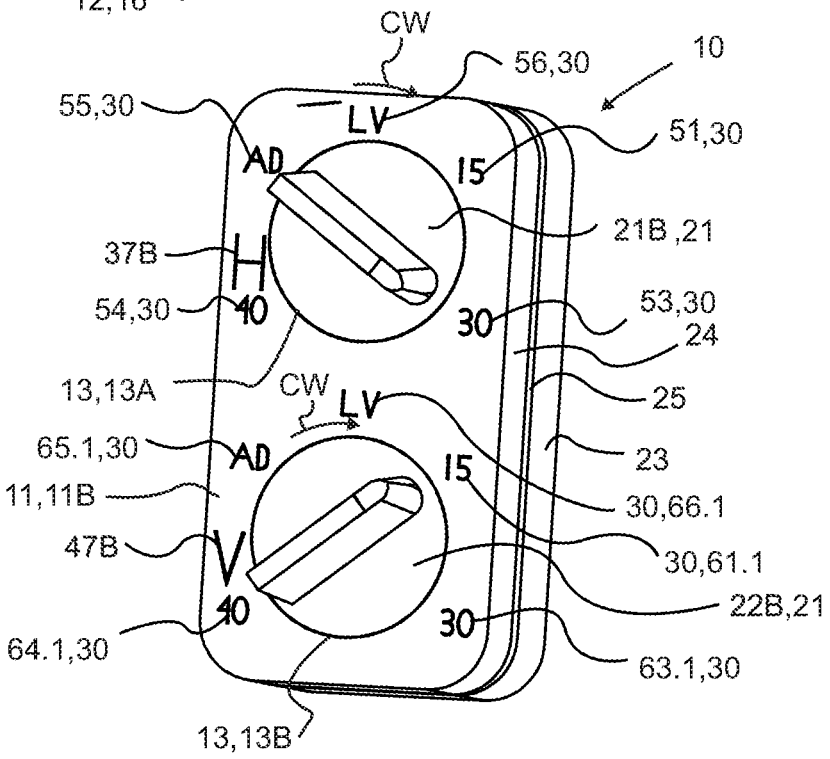
FIG. 2 is a backside perspective view of the exemplary embodiment of FIG. 1.
Figure 3:
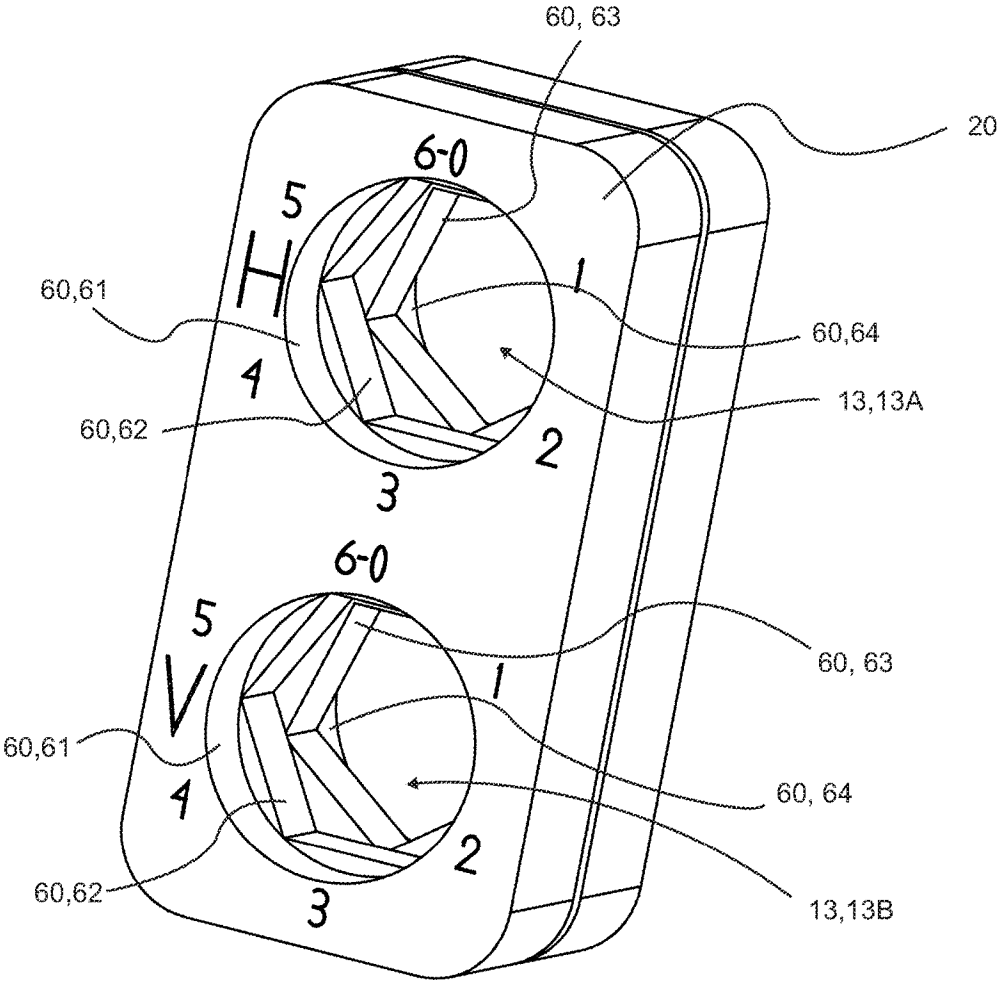
FIG. 3 is a front perspective view of an exemplary housing having a plurality of apertures therethrough having one or more layered aperture surfaces.

Referring now to FIGS. 1, 2 and 3, by way of example, and not limitation, there is illustrated an example embodiment apparatus of a combination sport racket vibration dampener and score keeping device 10. Sport racket vibration dampener and score keeping device 10 may include housing 20 having a front face or front surface, such as front 11A, a back face or back surface, such as back 113, and one or more holes or apertures 13 formed therethrough housing 20, such as first aperture 13A and second aperture 13B. Moreover, sport racket vibration dampener and score keeping device 10 may include a side surface or edge, such as perimeter 12. Perimeter 12 may include one or more sides, such as top side 14, bottom side 16, and one or more sides, such as first side 15 and second side 17. Moreover, perimeter 12 may be formed with a perimeter or two or more side cutout, such as groove 25, wherein groove 25 divides perimeter 12 into first side surface 23 and second side surface 24.

Furthermore, sport racket vibration dampener and score keeping device 10 may include one or more finger grip rotatable indicators 21 positioned therein one or more holes 13 formed therethrough housing 20. As shown in FIG. 1, one or more finger grip rotatable indicators 21 may include first dial 21A and second dial 22A (a matching pair such as first dial) positioned therein first aperture 13A and second aperture 13B, respectively. Still furthermore, and as shown in FIG. 2, one or more finger grip rotatable indicators 21 may include third dial 21B and fourth dial 22B (a matching pair such as second dial) positioned therein first aperture 13A and second aperture 13B, respectively.

Moreover, housing 20 of sport racket vibration dampener and score keeping device 10 may include indicia 30 to indicate incremental changes in a challenge, such as for example game and set score or other sport or challenge indicia indicators. More specifically, front 11A of housing 20 may include indicia 30, such as six (n+1) positions for indicia home "H" 37A the set score as follows, indicia nomenclature "1" 31 (game 1), indicia nomenclature "2" 32 (game 2), indicia nomenclature "3" 33 (game 3), indicia nomenclature "4" 34 (game 4), indicia nomenclature "5" 35 (game 5), and indicia nomenclature "6-0" 36 (game 6) and six (n+1) positions for indicia visitor "V" 47A the opponent's set score as follows, indicia nomenclature "1" (game 1), indicia nomenclature "2" 42 (game 2), indicia nomenclature "3" 43 (game 3), indicia nomenclature "4" 44 (game 4), indicia nomenclature "5" 45 (game 5), and indicia nomenclature "6-0" 46 (game 6). Full rotation here through six (6) games and player wins the set. Front 11A of housing 20 may also be used to keep score of a "tie break" game if each player achieves 6 games won in a single set. A "tie break" game is a single game played to decide the outcome of a set after each player wins six games. First player to 7 points wins the "tie break" game and therefore the set.

Flip side, back 11B of housing 20 may include indicia game score as follows, indicia nomenclature "15" 51, indicia nomenclature "30" 53, indicia nomenclature "40" 54, indicia nomenclature "AD" "Advantage" 55, and indicia nomenclature "LV" 56, and five (n) positions for indicia visitor "V" 47B the opponent's game score as follows, indicia nomenclature "15" 61.1, indicia nomenclature "30" 63.1, indicia nomenclature "40" 64.1, indicia nomenclature "AD" 65.1, and indicia nomenclature "LV" 66.1. Full rotation here through five point positions and player wins a single game.

It is contemplated herein that placement of home "H" and visitor "V" for both players scores on the same face side (rather than opposing sides) enhancing the players ability to immediately determine the home vs visitor game and set score relationship.

"LV" indicates the traditional tennis score representing a zero score or start. "15" indicates the first point won by the home "H" player or opponent or visitor "V". "30" indicates the second point won by the home "H" player or opponent or visitor "V". "40" indicates the third point won by the home "H" player or opponent or visitor "V". "AD" or Advantage indicates a score one point greater than an equal score of home "H"=40 vs. visitor "V"=40. Games won within a set are represented in traditional numerical order 0, 1, 2, 3, 4, 5, 6.

It is contemplated herein that front 11A may include one or more colors, such as first color which may be different from that of back 11B which may include second color, both colors providing the player with an immediate recognition of which side is game score and which is set score.

It is contemplated herein that sport racket vibration dampener and score keeping device 10 indicates scores for more than one player.

It is contemplated herein that sport racket vibration dampener and score keeping device 10 is configured to advance the score of a player when one or more finger grip rotatable indicators 21 is rotated.

Referring now to FIG. 3, by way of example, and not limitation, there is illustrated an example embodiment of housing 20. Housing 20 further includes one or more holes 13 formed therethrough housing 20, such as first aperture 13A and second aperture 13B, wherein first aperture 13A and second aperture 13B further includes one or more layered aperture surfaces, such as stacked aperture surfaces 60, which may include first rotational aperture surface 61 herein shown as a circle or circular configured surface layer, first ratchet aperture surface 62 herein shown as a five sided polygon configured surface or layer, second ratchet aperture surface 63 herein shown as a six sided polygon configured surface or layer, and second rotational aperture surface 64 herein shown as a circle or circular configured surface layer.

Figure 4:
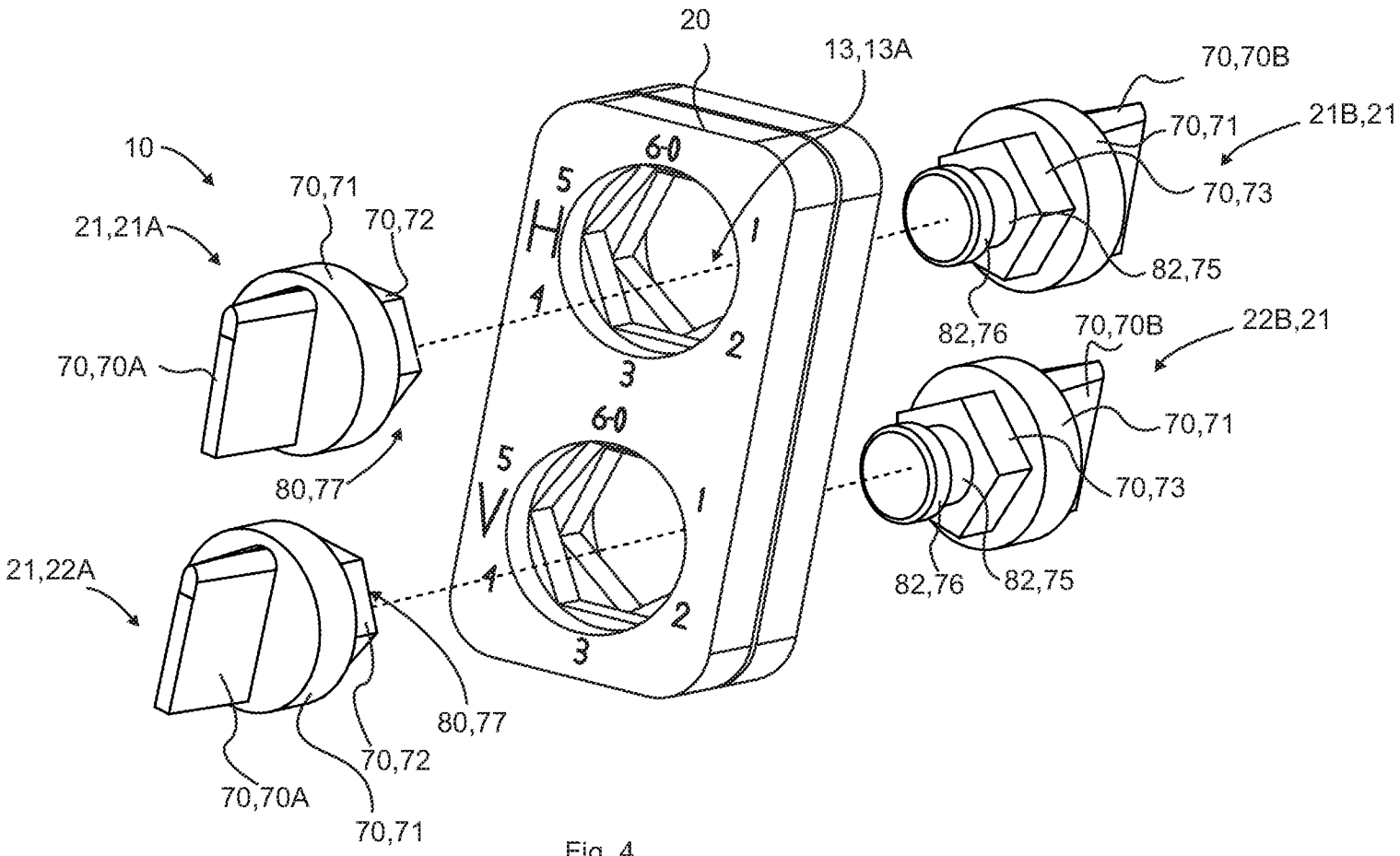
FIG. 4 is an exploded perspective view of the embodiment of FIG. 2.
Figure 5:
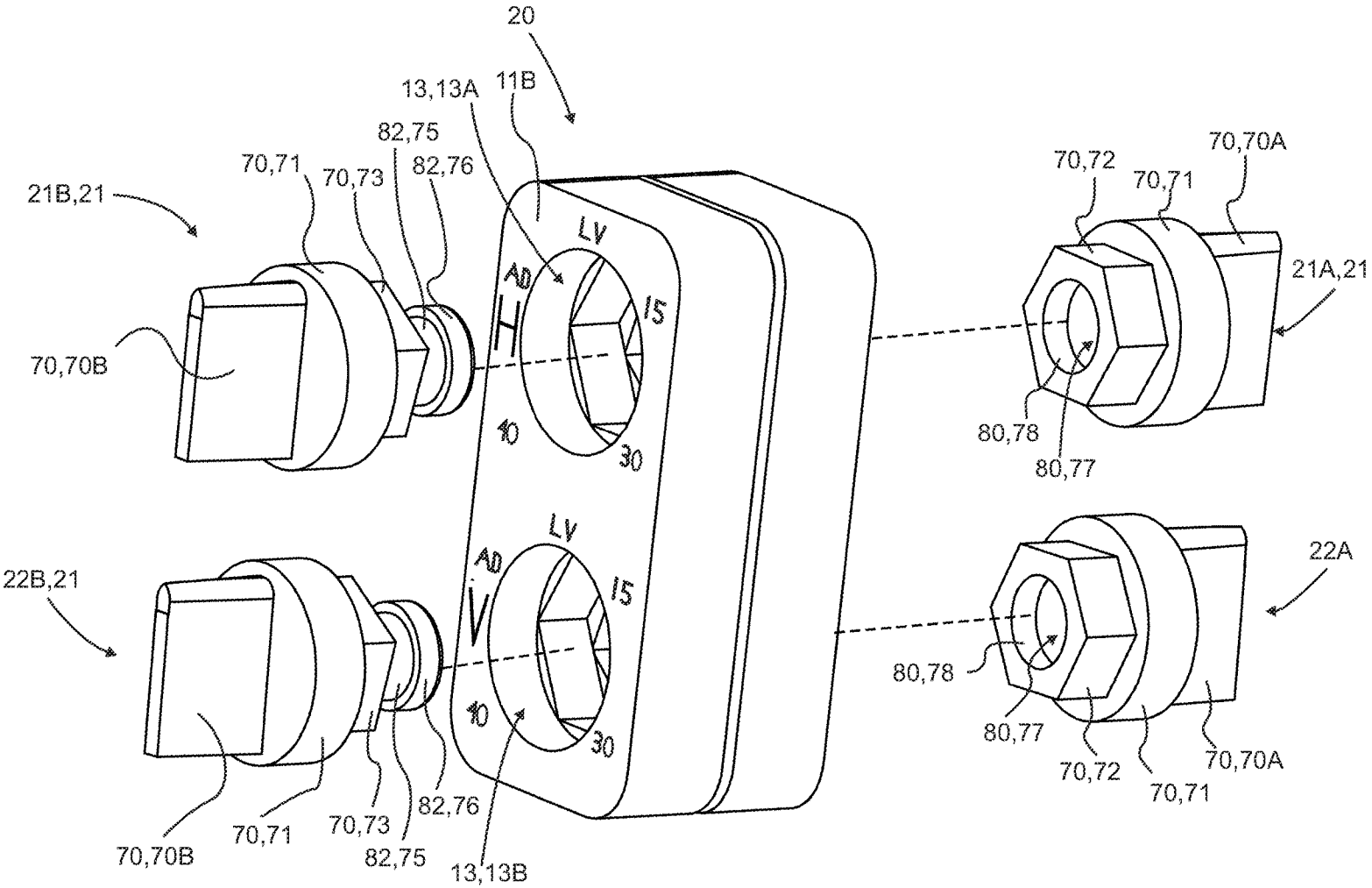
FIG. 5 is an exploded perspective view of the embodiment of FIG. 1.

Referring now to FIGS. 4 and 5, by way of example, and not limitation, there is illustrated an example embodiment of combination sport racket vibration dampener and score keeping device 10. Sport racket vibration dampener and score keeping device 10 may include one or more finger grip rotatable indicators 21 positioned therein one or more holes 13 formed therethrough housing 20. As shown in FIG. 1, one or more dials, pairs of dials, coupled pairs of dials, finger grip rotatable indicators 21, which may include first dial 21A, second dial 22A, third dial 21B, and fourth dial 22B. Moreover, first dial 21A and second dial 22A may further include one or more layered dial surfaces, such as stacked dial surfaces 70, which may include finger grip 70A, rotational dial surface layer 71 herein shown as a circle or circular configured surface layer, first ratchet dial surface layer 72 herein shown as a six sided polygon surface or layer. Furthermore, first dial 21A and second dial 22A may further include an attachment device or first attachment device 80, such as inlet or female coupler 77 having inside wall 78 of female coupler 77.

Moreover, third dial 21B and fourth dial 22B may further include one or more layered dial surfaces, such as stacked dial surfaces 70, which may include finger grip 70B, rotational dial surface layer 71 herein shown as a circular configured surface layer, second ratchet dial surface 73 herein shown as a five sided polygon surface or layer. Furthermore, third dial 21B and fourth dial 22B may further include an attachment device or second attachment device 82, such as extension 75 and protrusion or male coupler 76.

It is contemplated herein that male coupler 76 may be snapped or otherwise fitted together with female coupler 77 to rotationally maintain or hold first dial 21A and third dial 21B therein first aperture 13A and male coupler 76 may be snapped or otherwise fitted together with female coupler 77 to rotationally maintain or hold second dial 22A and fourth dial 22B therein second aperture 13B, respectively.

It is contemplated herein that each rotating dial's respective geometric shape and its corresponding aperture's respective geometric shape creates a precise ratcheting movement into an individual score positon and the number of polygon corners represents the number of positions of ratchet movement therearound. Moreover, this precise ratcheting movement aides players with near vision issues by reinforcing score position with a physical stop at the precise index or polygon corner position for each individual score positon.

It is further contemplated herein that each dial may include an annular snap feature, for example a female annular snap feature which snaps together with an opposing dial's male annular snap feature to releasably retain or removably affix one dial to the other.

Figure 6:
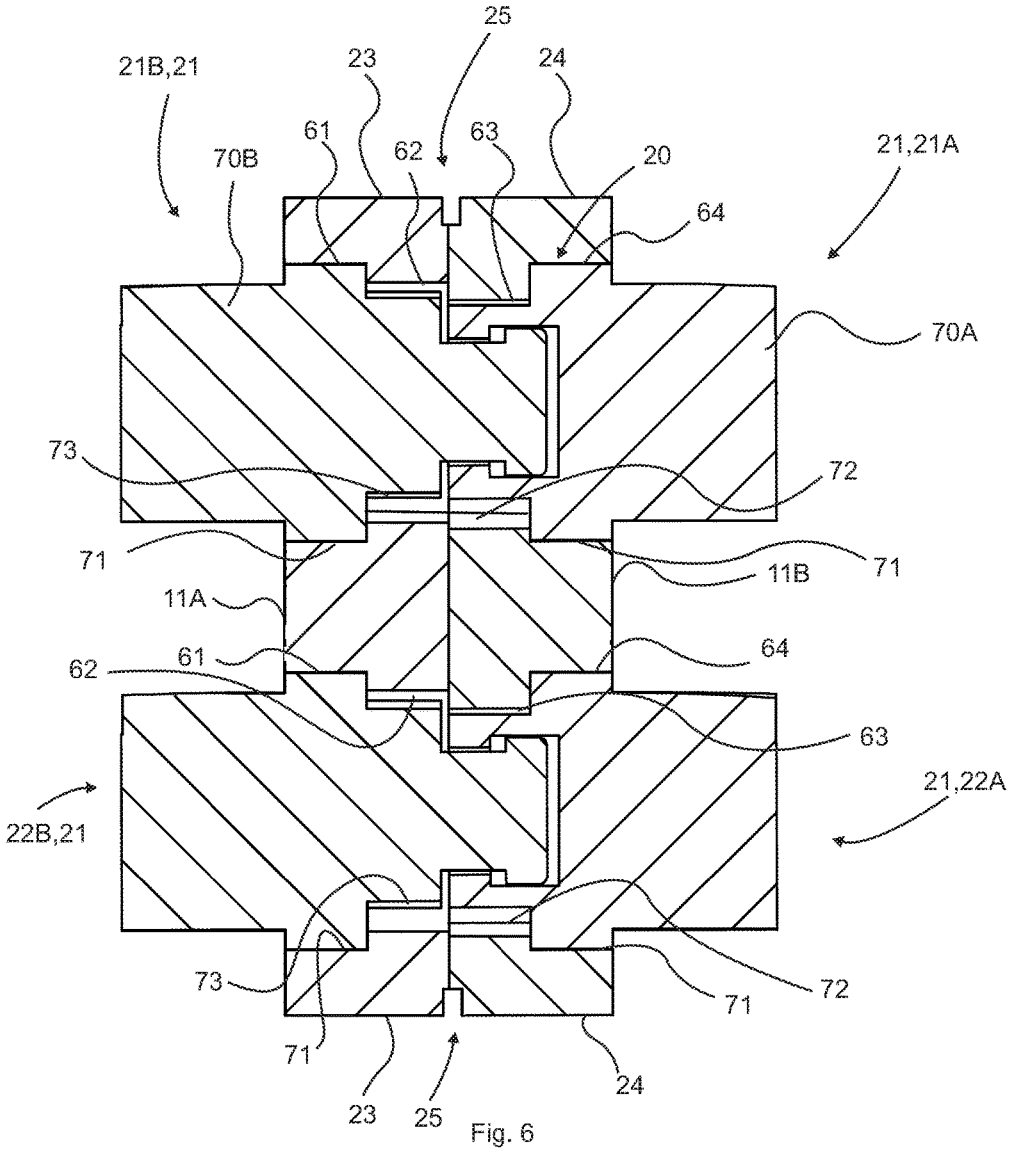
FIG. 6 is a vertical cross sectional view of the embodiment of FIG. 1 or 5.

Referring now to FIG. 6, by way of example, and not limitation, there is illustrated an example embodiment of a vertical cross sectional view of combination sport racket vibration dampener and score keeping device 10. When assembled, first dial 21A and third dial 213 are rotationally affixed or coupled therein first aperture 13A. Moreover, second dial 22A and fourth dial 22B are rotationally affixed or coupled therein second aperture 13B. It is contemplated herein that coupling may include any rotationally affixing, such as insertion thereof male coupler 76 therein female coupler 77 and wherein inside wall 78 of female coupler 77 rotationally grips, couples, connects or links thereto extension 75 of male coupler 76.

It is further contemplated herein that other gripper, coupler, connecter or linkage or the like to rotational connect first dial 21A and third dial 21B, and second dial 22A and fourth dial 22B one to the other therein first aperture 13A and second aperture 13B, respectively.

In use, first dial 21A and third dial 21B are independently rotationally coupled therein first aperture 13A, whereby third dial 21B may include rotational dial surface layer 71, herein shown as a circular configured surface layer, is preferably rotationally guided therein by first rotational aperture surface 61, herein shown as a circular configured surface layer, of first aperture 13A; second ratchet dial surface 73, herein shown as a five sided polygon surface or layer, is preferably ratchetably guided therein by first ratchet aperture surface 62, herein shown as a five sided polygon configured surface or layer, of first aperture 13A; and first dial 21A may include rotational dial surface layer 71, herein shown as a circular configured surface layer, is preferably rotationally guided therein by second rotational aperture surface 64, herein shown as a circular configured surface layer, of first aperture 13A; first ratchet dial surface layer 72 herein shown as a six sided polygon surface layer, is preferably ratchetably guided therein by first ratchet aperture surface 63 herein shown as a six sided polygon configured surface layer, of first aperture 13A.

Moreover, second dial 22A and fourth dial 22B are independently rotationally coupled therein second aperture 13B, whereby fourth dial 22B may include rotational dial surface layer 71, herein shown as a circular configured surface layer, is preferably rotationally guided therein by first rotational aperture surface 61, herein shown as a circular configured surface or layer, of second aperture 13B; second ratchet dial surface 73, herein shown as a five sided polygon surface layer, is preferably ratchetably guided therein by first ratchet aperture surface 62, herein shown as a five sided polygon configured surface or layer, of second aperture 13B; and second dial 22A may include rotational dial surface layer 71, herein shown as a circular configured surface layer, which is preferably rotationally guided therein by second rotational aperture surface 64, herein shown as a circular configured surface layer, of second aperture 13B; first ratchet dial surface layer 72 herein shown as a six sided polygon surface layer, is preferably ratchetably guided therein by first ratchet aperture surface 63 herein shown as a six sided polygon configured surface layer, of second aperture 13B.

It is further contemplated herein that first dial 21A and third dial 21B and that second dial 22A and fourth dial 22B are snapped or rotationally affixed together and enabled to be rotated independent of one another to keep different scores (the other dial may remain in place or be rotated to its next score position). Moreover, each dial may have a unique polygon exterior shape (for example pentagon or hexagon) which corresponds to the rubber housing polygon shaped openings or apertures.

It is further contemplated herein that second ratchet dial surface 73, herein shown as a five sided polygon surface layer, is preferably ratchetably guided therein by first ratchet aperture surface 62, herein shown as a five sided polygon configured surface layer, of second aperture 13B is preferably a five sided polygon to enable five dial positions of back 11B shown as five (n) positions for indicia home "H" 37B the game score as follows, indicia nomenclature "15" 51, indicia nomenclature "30" 53, indicia nomenclature "40" 54, indicia nomenclature "AD" 55, and indicia nomenclature "LV" 56, and five (n) positions for indicia visitor "V" 47B the opponent's game score as follows, indicia nomenclature "15" 61.1, indicia nomenclature "30" 63.1, indicia nomenclature "40" 64.1, indicia nomenclature "AD" 65.1, and indicia nomenclature "LV" 66.1.

It is still further contemplated herein that first ratchet dial surface layer 72 herein shown as a six sided polygon surface layer, is preferably ratchetably guided therein by first ratchet aperture surface 63 herein shown as a six sided polygon configured surface layer, of second aperture 13B to enable six dial positions of front 11A shown as six (n+1) positions for indicia home "H" 37A the set score as follows, indicia nomenclature "1" 31, indicia nomenclature "2" 32, indicia nomenclature "3" 33, indicia nomenclature "4" 34, indicia nomenclature "5" 35, and indicia nomenclature "6-0" 36 and six (n+1) positions for indicia visitor "V" 47A the opponent's set score as follows, indicia nomenclature "1" 41, indicia nomenclature "2" 42, indicia nomenclature "3" 43, indicia nomenclature "4" 44, indicia nomenclature 45, and indicia nomenclature "6-0" 46.

It is contemplated herein that housing 20 is preferably made of one or more of a variety of shock absorbing materials, including by way of example but not by way of limitation, a plastic polymer, rubber, foam rubber, or a rubber-like material or other flexible material ideal for enabling first dial 21A and third dial 21B and that second dial 22A and fourth dial 22B to rotate therein first aperture 13A and second aperture 13B, respectively to enable at least one rotary scoring mechanism. Additionally, housing 20 may comprise a rubber or plastic outer shell encompassing a fluid (e.g., water or an oil) to provide hydrodynamic dampening. A pliant or plastic material will absorb energy of the initial impulse and subsequent string and racquet vibrations transmitted along the racquet strings.

Referring again to FIGS. 4, 5, and 6, ratchet herein of one position movement is enabled by a rigid polygon dial surface layer rotating one position at a time therein flexible polygon aperture surface layer.

Figure 7:
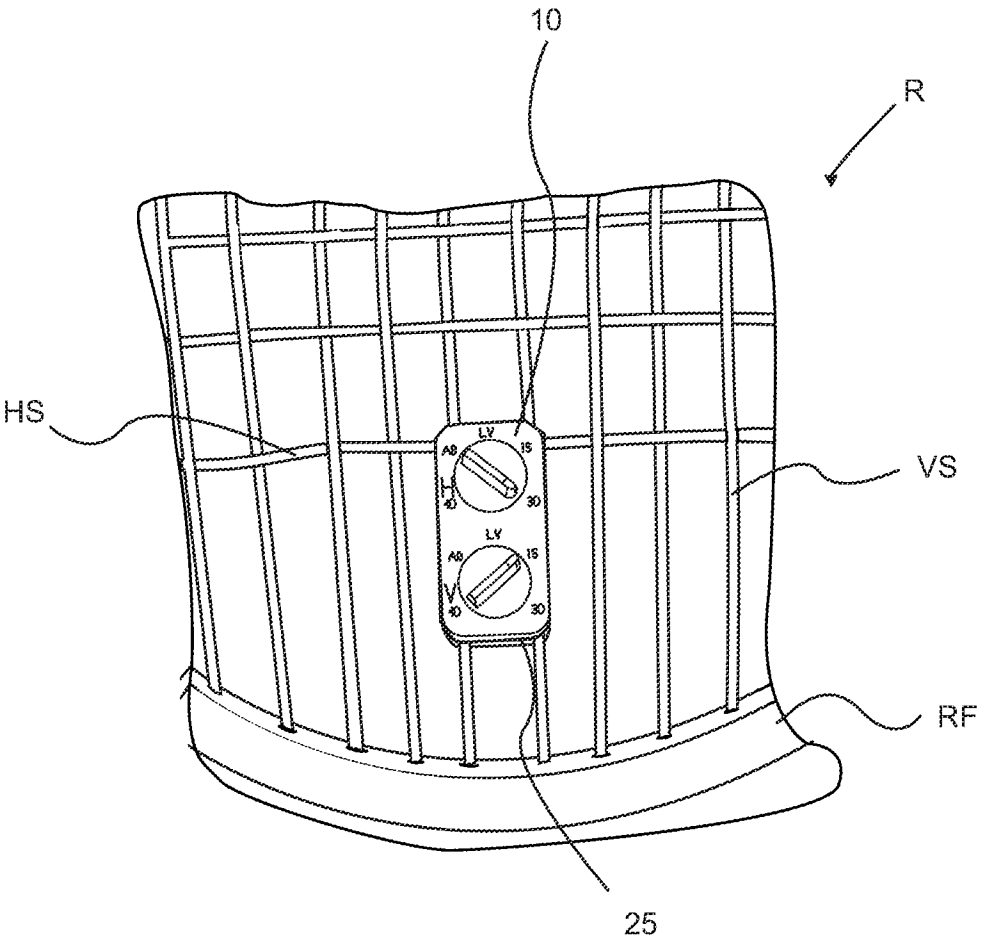
FIG. 7 is a front perspective view of an exemplary embodiment of FIG. 2, shown integrated with strings of a partial view of a racket.

Referring now to FIG. 7, by way of example, and not limitation, there is illustrated an example embodiment of a partial plan view of combination sport racket vibration dampener and score keeping device 10, shown integrated therein the strings of a racket R. Sport racket vibration dampener and score keeping device 10 may be positioned or fastened between two vertical strings VS proximate racket frame RF and more specifically vertical strings VS may be positioned therein groove 25, wherein groove 25 divides perimeter 12 of housing 20 into first side surface 23 and second side surface 24. Moreover vibration dampening is achieved using a rubber composite for housing 20 whereby such rubber composite absorbs vibration between strings, such as vertical strings VS and horizontal strings HS.

It is contemplated herein that housing 20 is preferably made of a rubber material or other flexible material ideal for reducing or absorbing tennis ball impact on racket strings (VS and/or HS), therefore minimizing stress on the player's wrist, elbow, and shoulder.

Figure 8:
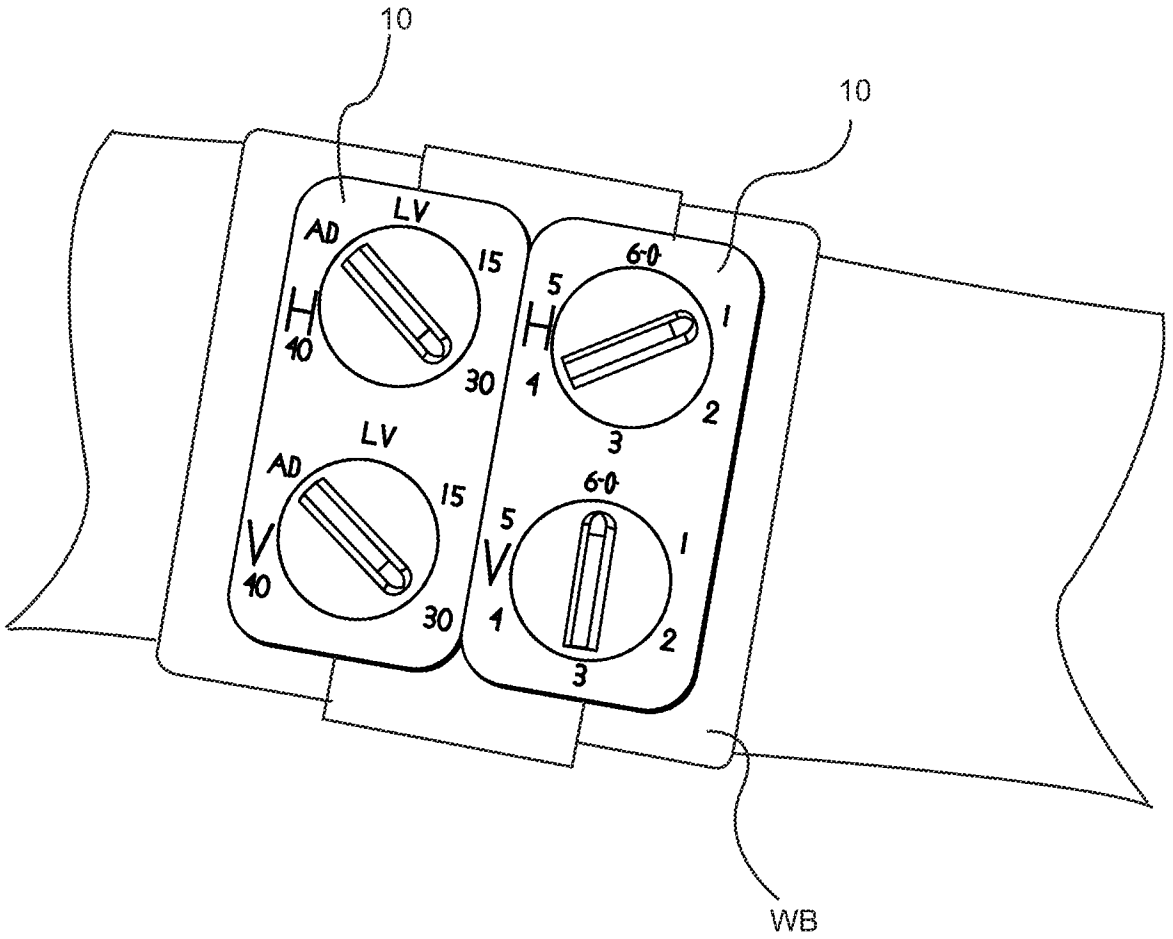
FIG. 8 is a front perspective view of an exemplary embodiment of FIGS. 1 and 2, shown integrated with wrist strap.

Referring now to FIG. 8, by way of example, and not limitation, there is illustrated an example embodiment of two combination sport racket vibration dampener and score keeping device 10, shown integrated thereto a strap, band, or belt, such as wrist band WB. For players not interested in playing with a dampener in their racket string bed, this exemplary embodiment combines set and game scores utilizing two score keeping device 10 affixed to wrist band WB on the front face only.

Figure 9:
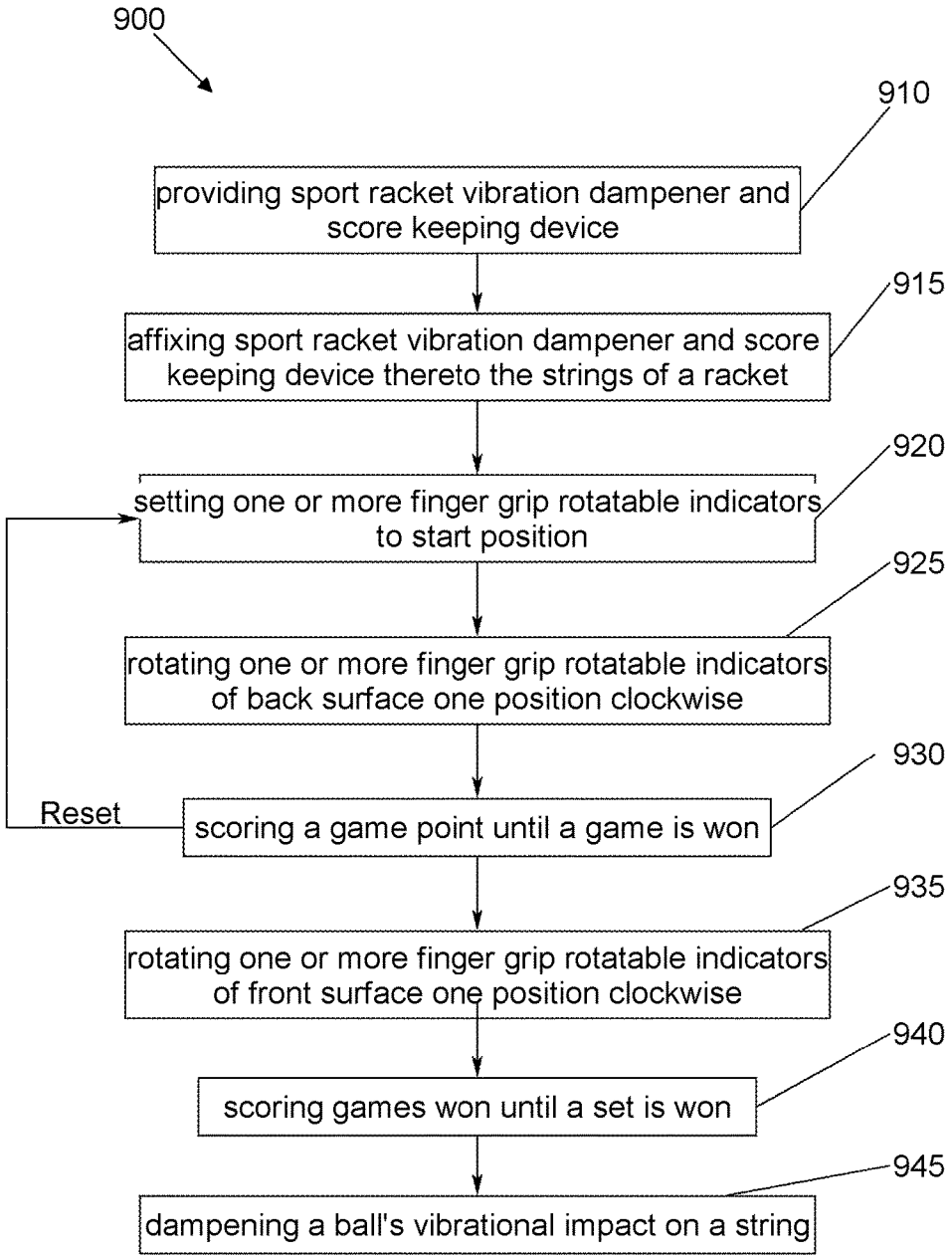
FIG. 9 is a flow diagram of a method sport racket score keeping and vibration dampening.

Referring now to FIG. 9, there is illustrated a flow diagram 900 of a method of utilizing sport racket vibration dampener and score keeping device 10 to dampen racket R vibration and/or keep score of a two player single or dual scoring event. In block or step 910, providing sport racket vibration dampener and score keeping device 10, as described above in FIGS. 1-7. In block or step 915, affixing sport racket vibration dampener and score keeping device thereto the strings of a racket R. In block or step 920, starting a new score keeping event by setting one or more finger grip rotatable indicators 21 to start position, such as, first dial 21A to indicia nomenclature "6-0" 36, second dial 22A to indicia nomenclature "6-0" 46, third dial 21B to indicia nomenclature "LV" 56, and fourth dial 22B to indicia nomenclature "LV" 66.1 (start position). In block or step 925, rotating one or more finger grip rotatable indicators 21 of back 11B one position clockwise CW for either indicia home "H" 37B or indicia visitor "V" 47B via third dial 21B or fourth dial 22B, respectively for each player or opponents victorious point won or event won. One rotation stop clockwise CW for each opponents victorious point won or event won, example iteration, indicia nomenclature "15" 51, indicia nomenclature "30" 53, indicia nomenclature "40" 54, indicia nomenclature "AD" 55, and indicia nomenclature "LV" 56. In block or step 930, scoring a win of a game—one of the player or opponents completes a full rotation (360 degrees) clockwise CW rotation of one or more finger grip rotatable indicators 21 of back 11B—five positions or stops clockwise CW for either indicia home "H" 37B or indicia visitor "V" 47B via third dial 21B or fourth dial 22B.

In block or step 935, rotating one or more finger grip rotatable indicators 21 of front 11A one position clockwise CW for either indicia home "H" 37A or indicia visitor "V" 47A via first dial 21A or second dial 22A, respectively for each player or opponents victorious game win as achieved on back 11B until one player is the first to rotate therearound (360 degrees) clockwise CW through 6 games, for example, indicia nomenclature "1" 41, indicia nomenclature "2" 42, indicia nomenclature "3" 43, indicia nomenclature "4" 44, indicia nomenclature "5" 45, and indicia nomenclature "6-0" 46. In block or step 940, scoring a win of a set—full (360 degrees) clockwise CW rotation of one or more finger grip rotatable indicators 21 of back 11B five positions clockwise CW for either indicia home "H" 37B or indicia visitor "V" 47B via third dial 21B or fourth dial 22B. Restart/Reset the Game score keep—rotate one or more finger grip rotatable indicators 21 to start position, such as, third dial 21B to indicia nomenclature "LV" 56, and fourth dial 22B to indicia nomenclature "LV" 66.1 for indicia home "H" 37B and indicia visitor "V" 47B via third dial 21B or fourth dial 22B.

In block or step 940, scoring a win of a set—one of the player or opponents completes a full rotation (360 degrees) clockwise CW rotation of one or more finger grip rotatable indicators 21 of front 11A—six positions or stops clockwise CW for either indicia home "H" 37A or indicia visitor "V" 47A via first dial 21A or second dial 22A.

In block or step 945, dampening a ball's vibrational impact on a string, such as vertical string VS and horizontal string HS of racket R.

The foregoing description and drawings comprise illustrative embodiments of the present disclosure. Having thus described exemplary embodiments, it should be noted by those ordinarily skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments of the disclosure will come to mind to one ordinarily skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein, but is limited only by the following claims.

What is claimed is:

1. An apparatus to keep score of points in a game and games in a set during a racket match, said apparatus comprising:

a housing having a perimeter, a front surface and a back surface, each surface configured with an indicia to indicate the game and set score, said perimeter having a groove therearound, and said housing includes a pair of apertures, each of said pair of apertures having one or more layered aperture surfaces, wherein said one or more layered aperture surfaces includes a first ratchet aperture surface configured as a hexagon and a second ratchet aperture surface configured as a pentagon; and two pairs of dials, each of said pair of dials having one or more layered dial surfaces, said one or more layered dial surfaces includes a first ratchet dial surface configured as a hexagon and a second ratchet dial surface configured as a pentagon, wherein each of said pairs of dials is rotationally positioned therein one of said pair of apertures;

wherein each of said pairs of dials includes a finger grip, an indicator, a base, and a connector.

2. The apparatus of claim 1, wherein said housing is configured from a flexible material.

3. The apparatus of claim 1, wherein said indicia on said front surface are selected from the group consisting of home, H, visitor, V, 1, 2, 3, 4, 5, 6-0, and combinations thereof.

4. The apparatus of claim 3, wherein said indicia on said front surface is configured in a first color.

5. The apparatus of claim 1, wherein said indicia on said back surface are selected from the group consisting of home, H, visitor, V, 15, 30, 4, AD, advantage, love, LV, and combinations thereof.

6. The apparatus of claim 5, wherein said indicia on said back surface is configured in a second color.

7. The apparatus of claim 1, wherein each of said one or more layered aperture surfaces further comprises a first rotational aperture surface configured as a circle and a second rotational aperture surface configured as a circle.

8. The apparatus of claim 1, wherein each of said one or more layered dial surfaces further comprises a rotational dial surface layer configured as a circle.

9. The apparatus of claim 1, wherein said connector further comprises an annular connection between a female coupler and a male coupler to rotationally couple each of said pair of dials to enable at least one rotary scoring mechanism.

10. The apparatus of claim 1, wherein said housing is removeably affixed to a set of racket strings.

11. The apparatus of claim 1, wherein two said apparatus are affixed to a wrist band.

12. The apparatus of claim 1, wherein said apparatus indicates scores for more than one player.

13. The apparatus of claim 1, wherein said apparatus is utilized to advance the score of a player for the game and the set when one of said pair of dials is rotated.

* * * * *